US008608154B2

(12) United States Patent
Yamada

(10) Patent No.: US 8,608,154 B2
(45) Date of Patent: Dec. 17, 2013

(54) SHEET TRAY AND IMAGE FORMING APPARATUS INCLUDING SAME

(75) Inventor: Shintaroh Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/539,640

(22) Filed: Jul. 2, 2012

(65) Prior Publication Data

US 2013/0009359 A1 Jan. 10, 2013

(30) Foreign Application Priority Data

Jul. 8, 2011 (JP) ..... 2011-151896

(51) Int. Cl.
*B65H 3/44* (2006.01)

(52) U.S. Cl.
USPC ..... 271/9.13; 271/164

(58) Field of Classification Search
USPC ..... 271/9.11, 9.13, 164
See application file for complete search history.

(56) References Cited

U.S. PATENT DOCUMENTS 5,065,180 A * 11/1991 Shindo et al. ..... 355/72
5,157,448 A * 10/1992 Lang ..... 399/23
5,765,826 A * 6/1998 Isoda et al. ..... 271/162
6,102,386 A * 8/2000 Shigetomi et al. ..... 271/9.11
2005/0201765 A1* 9/2005 Shinga ..... 399/16

FOREIGN PATENT DOCUMENTS

JP 01-317937 A 12/1989
JP 2137587 A 5/1990
JP 07-057650 A 3/1995
JP 2005-084181 A 3/2005
JP 2006-184855 A 7/2006

* cited by examiner

*Primary Examiner* — Jeremy R Severson
(74) *Attorney, Agent, or Firm* — Harness, Dickey & Pierce, P.L.C.

(57) ABSTRACT

A sheet tray for feeding a sheet toward an image forming part of an image forming apparatus. The sheet tray is detachably attachable to the image forming apparatus in a sheet feeding direction and includes a tray portion, a detachable cover member provided apart from the tray portion with a gap interposed therebetween through which the sheet passes in an engaged state in which the tray portion and the cover member are engaged with each other, a lock assembly that engages the tray portion and the cover member with each other in the engaged state and disengages the cover member and the tray portion from each other in a disengaged state, and a switching mechanism that puts the lock assembly into the engaged state in absence of the sheet within the gap and into the disengaged state at presence of the sheet within the gap.

9 Claims, 10 Drawing Sheets

SHEET TRAY AND IMAGE FORMING APPARATUS INCLUDING SAME

CROSS-REFERENCE TO RELATED APPLICATION

The present patent application is based on and claims priority pursuant to 35 U.S.C. §119 from Japanese Patent Application No. 2011-151896, filed on Jul. 8, 2011 in the Japan Patent Office, which is incorporated by reference herein in its entirety.

BACKGROUND OF THE INVENTION

1. Field of the Invention

Illustrative embodiments described in this patent specification generally relate to a sheet tray and an image forming apparatus, and more particularly to a sheet tray that facilitates fixing of sheet jams and an image forming apparatus including the sheet tray.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

In general, multiple sheet trays, each detachably attachable to the image forming apparatus and holding recording media, are disposed one above the other in a lower part of the image forming apparatus, below an image forming part of the image forming apparatus. An internal conveyance path extending in a substantially vertical direction is needed for such an image forming apparatus to convey the recording media from the sheet trays to the image forming part of the image forming apparatus disposed above the sheet trays. For good operation and also for ease of servicing, a configuration that facilitates fixing of a sheet jam in the conveyance path is crucial.

In some image forming apparatuses, the sheet trays are attached to and detached from the apparatus in a direction perpendicular to a sheet feeding direction in which sheets are fed from the sheet trays. In other image forming apparatuses, the sheet trays are attached to and detached from the apparatus in the sheet feeding direction. Configurations that facilitate fixing of a sheet jam have been proposed for both types of the image forming apparatuses.

For example, JP-2005-084181-A discloses an image forming apparatus including a sheet tray withdrawable from the apparatus, a lock mechanism that prevents the sheet tray from being withdrawn from the apparatus, a sheet feed unit that feeds a sheet in a direction perpendicular to a direction of withdrawal of the sheet tray from the apparatus, an open/close member provided immediately downstream from the sheet feed unit to open a sheet conveyance path, and a detector that detects presence or absence of the sheet in the sheet conveyance path. When a sheet jam is detected in the sheet conveyance path, withdrawal of the sheet tray from the apparatus is prevented by the lock mechanism. Accordingly, the sheet jammed in the sheet conveyance path is prevented from being torn apart by withdrawal of the sheet tray, thereby preventing the torn sheet from remaining within the image forming apparatus.

However, the above-described configuration is useful only for the image forming apparatus in which the direction of withdrawal of the sheet tray is perpendicular to the sheet feeding direction. Therefore, it is still difficult to access the jammed sheet in the image forming apparatuses in which the direction of withdrawal of the sheet tray is parallel to the sheet feeding direction.

In another approach, JP-2006-184855-A discloses an image forming apparatus including a sheet feeder detachably attachable to the image forming apparatus in a sheet feeding direction, a first conveyance unit that conveys a sheet from the sheet feeder, an image forming unit that forms an image on one side of the sheet conveyed by the first conveyance unit, a second conveyance unit that conveys the sheet having an image formed by the image forming unit, a fixing unit that fixes the image formed on the sheet conveyed by the second conveyance unit, and a return unit that returns the sheet from the fixing unit to an upstream portion from the first conveyance unit so as to form an image on the other side of the sheet. The sheet feeder, the first and second conveyance units, and the return unit are together withdrawable from the image forming apparatus in the sheet feeding direction. The above-described configuration allows easy removal of the jammed sheet from the image forming apparatus without damaging the sheet.

In yet another approach, JP-H07-057650-A discloses an image forming apparatus including a sheet feeder disposed one of above and below an image forming part, a sheet discharger disposed the other one of above and below the image forming part, a substantially vertical sheet conveyance path disposed between the sheet feeder and the sheet discharger via the image forming part, and a conveyance mechanism that conveys a sheet through the sheet conveyance path. A main portion of the image forming part and the sheet feeder are installed in an immovable part of the image forming apparatus, and a conveyance unit including a part of the conveyance mechanism is supported by the apparatus rotatably around a bottom portion of the apparatus. As a result, the conveyance unit is withdrawn from the apparatus to expose the sheet conveyance path to the outside of the apparatus when a sheet jam occurs, thereby facilitating fixing of the sheet jam.

However, in both of the above two image forming apparatuses, a substantial part of the apparatus needs to be withdrawn in order to remove the jammed sheet. Consequently, the withdrawable part must be strong, thereby increasing the weight of the apparatus and inconveniencing the user to fix a sheet jam.

BRIEF SUMMARY OF THE INVENTION

In view of the foregoing, illustrative embodiments described herein provide a novel sheet tray in which a direction of withdrawal of the sheet tray is perpendicular to a sheet feeding direction in which a sheet is fed from the sheet tray. The sheet tray has a light-weight configuration that facilitates fixing of a sheet jam. Illustrative embodiments described herein also provide a novel image forming apparatus including the sheet tray.

In one illustrative embodiment, a sheet tray for feeding a sheet toward an image forming part of an image forming apparatus, the sheet tray detachably attachable to the image forming apparatus in a sheet feeding direction includes a tray portion to hold the sheet, a cover member detachable from the tray portion, disposed downstream from the tray portion in the sheet feeding direction, and provided apart from the tray portion with a gap interposed therebetween through which the sheet passes in an engaged state in which the tray portion and the cover member are engaged with each other, a lock assembly that engages the tray portion and the cover member with each other in the engaged state and disengages the cover member and the tray portion from each other in a disengaged state, and a switching mechanism that puts the lock assembly into the engaged state in absence of the sheet within the gap between the tray portion and the cover member and into the disengaged state at presence of the sheet within the gap between the tray portion and the cover member.

In another illustrative embodiment, an image forming apparatus includes the sheet tray described above.

In yet another illustrative embodiment, a method for feeding a sheet from the sheet tray described above includes the steps of determining whether or not the cover member is in a predetermined position downstream from the tray portion in the sheet feeding direction, starting feeding of the sheet from the sheet tray, activating a lock solenoid to keep the tray portion and the cover member together, determining whether or not a trailing edge of the sheet fed from the sheet tray is detected, and deactivating the lock solenoid to disengage the tray portion and the cover member from each other when the trailing edge of the sheet is not detected.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
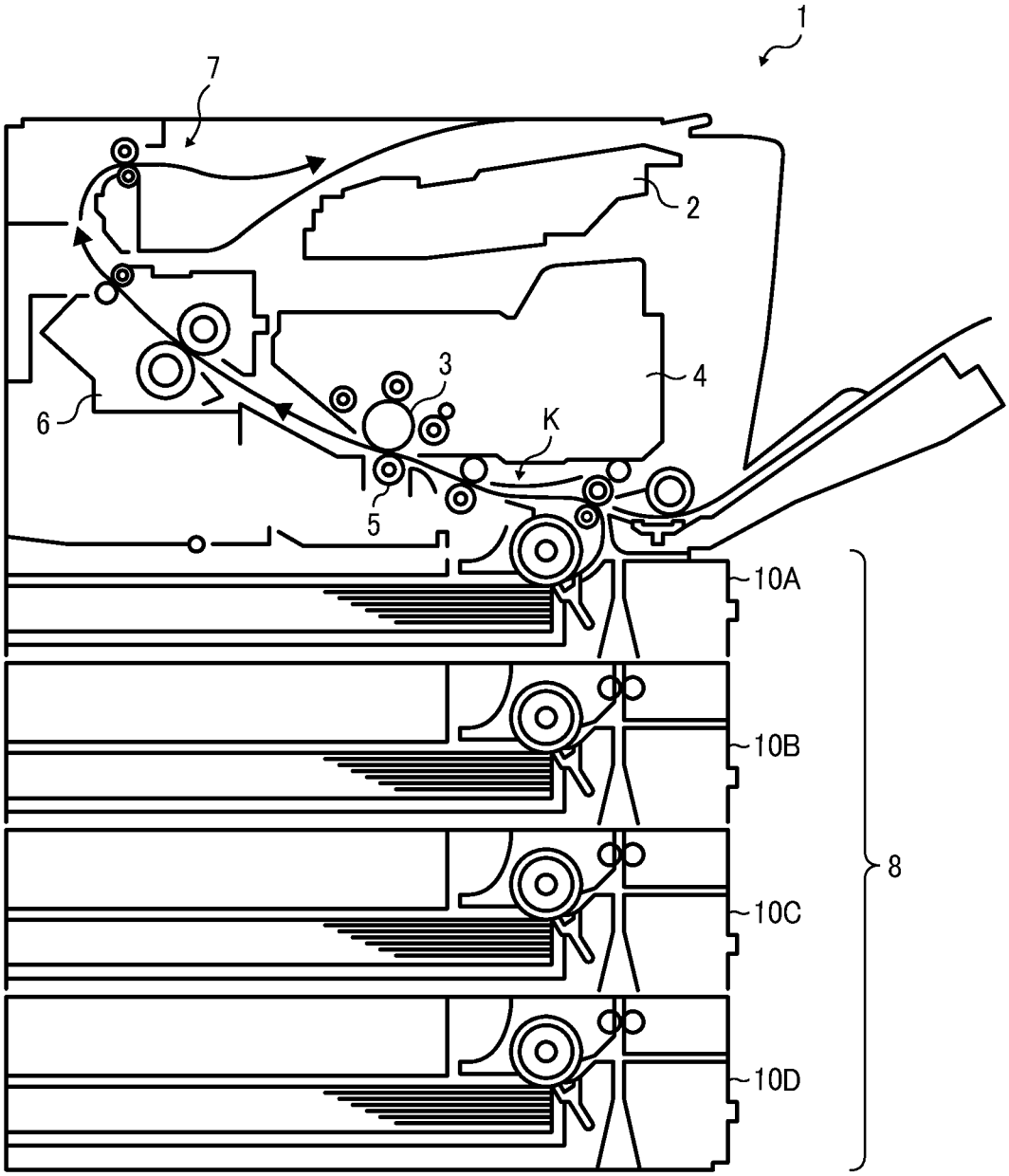
FIG. 1 is a vertical cross-sectional view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

FIG. 1 is a vertical cross-sectional view illustrating an example of a configuration of an image forming apparatus 1 according to illustrative embodiments. The image forming apparatus 1 includes a light source 2 that emits a light beam based on image data, a photoconductor 3 onto which the light beam emitted from the light source 2 is directed so that a latent image is formed thereon, an imaging unit 4 that supplies toner to the photoconductor 3 to form a toner image on the photoconductor 3, a transfer roller 5 that presses a recording medium such as a sheet P against the photoconductor 3 to transfer the toner image from the photoconductor 3 onto the sheet P, a fixing unit 6 that fixes the transferred toner image to the sheet P, a sheet discharger 7 that discharges the sheet P having the fixed toner image thereon from the image forming apparatus 1, and a sheet feeder 8 that feeds the sheet P to an image forming part of the image forming apparatus 1.

It is to be noted that the image forming part is constructed of the light source 2, the photoconductor 3, the imaging unit 4, the transfer roller 5, the fixing unit 6, and the sheet discharger 7.

When image data including electrical signals is supplied to the image forming apparatus 1, the light source 2 emits a light beam such as laser light based on the image data.

In the imaging unit 4, a surface of the photoconductor 3 is charged by a charger, not shown, and the light beam emitted from the light source 2 is directed onto the charged surface of the photoconductor 3 so that a latent image is formed on the photoconductor 3. The latent image is then developed with toner so that a toner image is formed on the photoconductor 3.

Meanwhile, a sheet P is fed from the sheet feeder 8. The sheet P thus fed is pressed against the photoconductor 3 by the transfer roller 5 so that the toner image formed on the photoconductor 3 is transferred onto the sheet P.

The toner image thus transferred onto the sheet P is fixed onto the sheet P by heat and pressure supplied from a fixing roller provided to the fixing unit 6. Thereafter, the sheet P having the fixed toner image thereon is discharged from the image forming apparatus 1 by the sheet discharger 7.

The sheet feeder 8 is disposed below the image forming part of the image forming apparatus 1, and includes stacked sheet trays 10A, 10B, 10C, and 10D (hereinafter collectively referred to as sheet tray(s) 10), each holding a stack of sheets P, and a roller assembly provided to the image forming apparatus 1 and described in detail later. The sheet trays 10 are disposed one above the other, and are withdrawable from the image forming apparatus 1 (to the right in FIG. 1).

Figure 2:
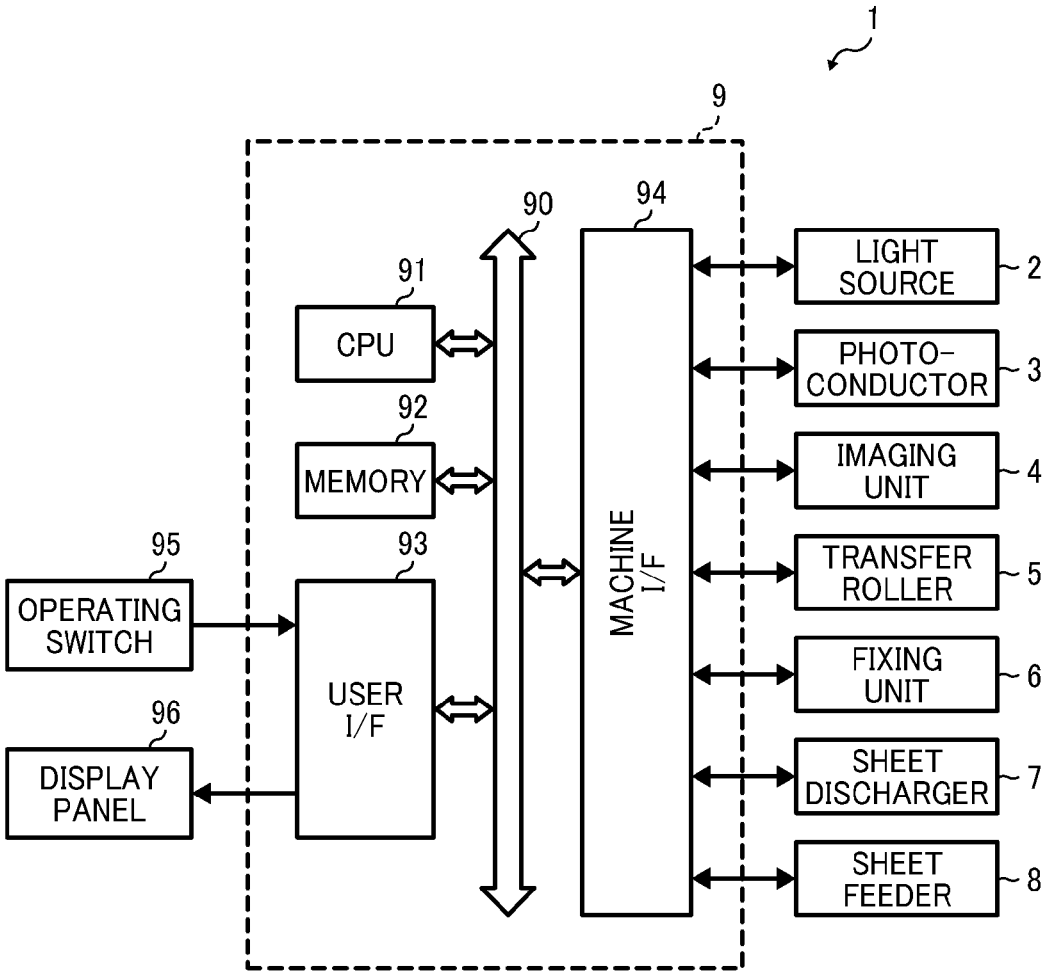
FIG. 2 is a block diagram illustrating an example of a configuration of a control unit installed in the image forming apparatus.

FIG. 2 is a block diagram illustrating an example of a configuration of a control unit 9 installed in the image forming apparatus 1.

The control unit 9 includes a CPU 91, a memory 92, a user interface (I/F) 93, and a machine interface (I/F) 94, each of which is connected to a bus 90.

The user I/F 93 is connected to an operating switch 95 that is operated by a user and a display panel 96 that displays an operating status of the image forming apparatus 1.

An actuator such as a motor and a solenoid and a sensor such as a photoelectric switch, which are provided to the light source 2, the photoconductor 3, the imaging unit 4, the transfer roller 5, the fixing unit 6, the sheet discharger 7, or the sheet feeder 8, are connected to the machine I/F 94.

Figure 3:
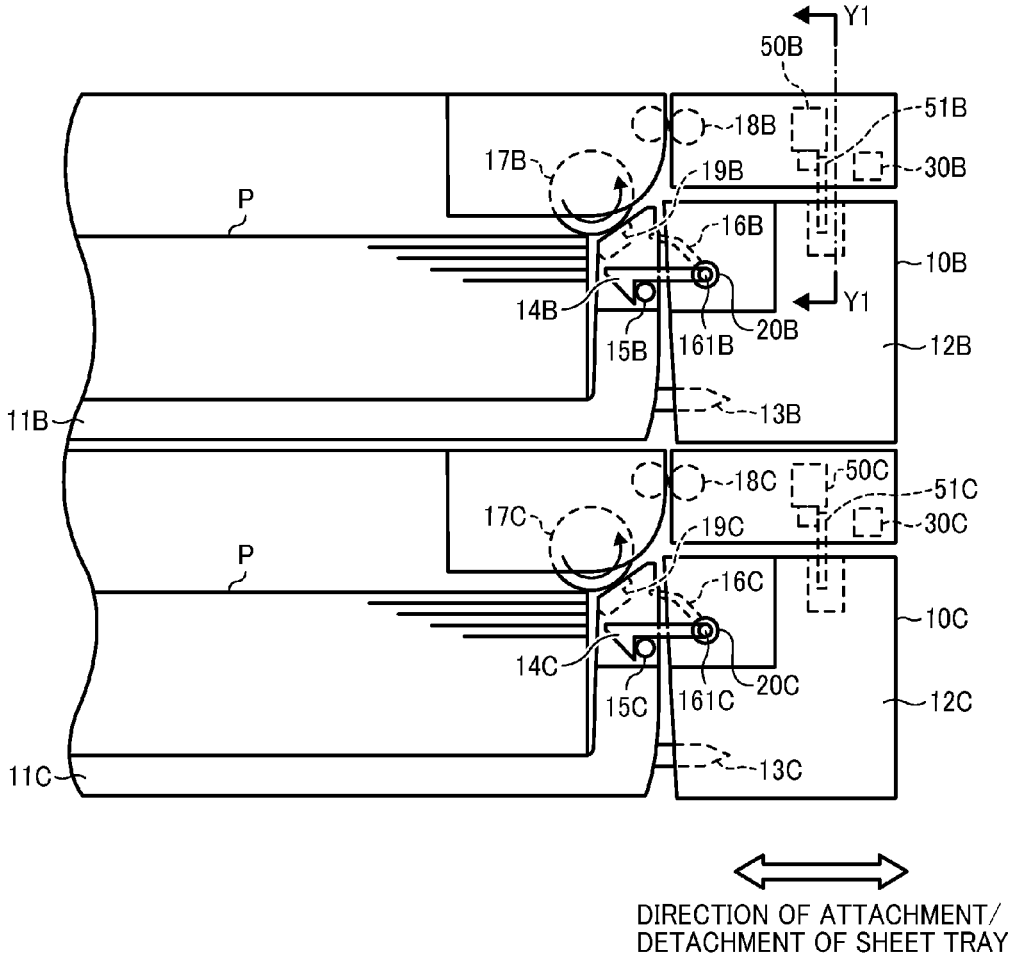
FIG. 3 is an enlarged cross-sectional view illustrating an example of a configuration of sheet trays according to a first illustrative embodiment in a state in which neither of the sheet trays supplies a sheet.
Figure 4:
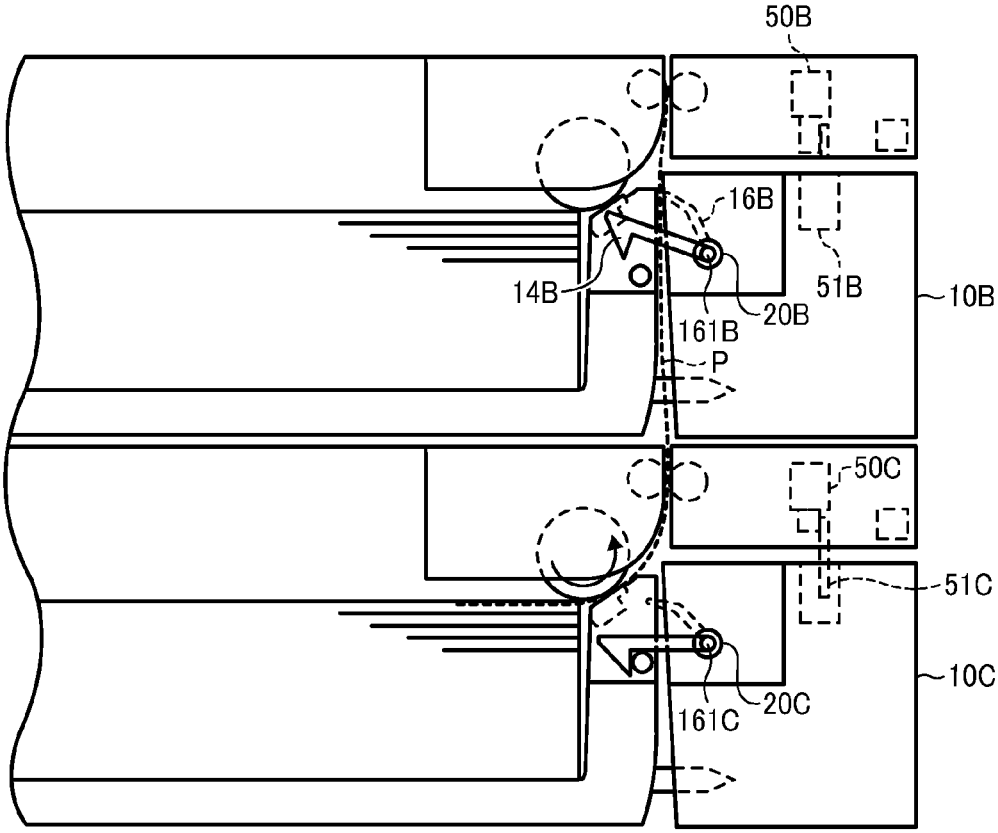
FIG. 4 is an enlarged cross-sectional view illustrating an example of a configuration of the sheet trays according to the first illustrative embodiment in a state in which a sheet is supplied.
Figure 5:
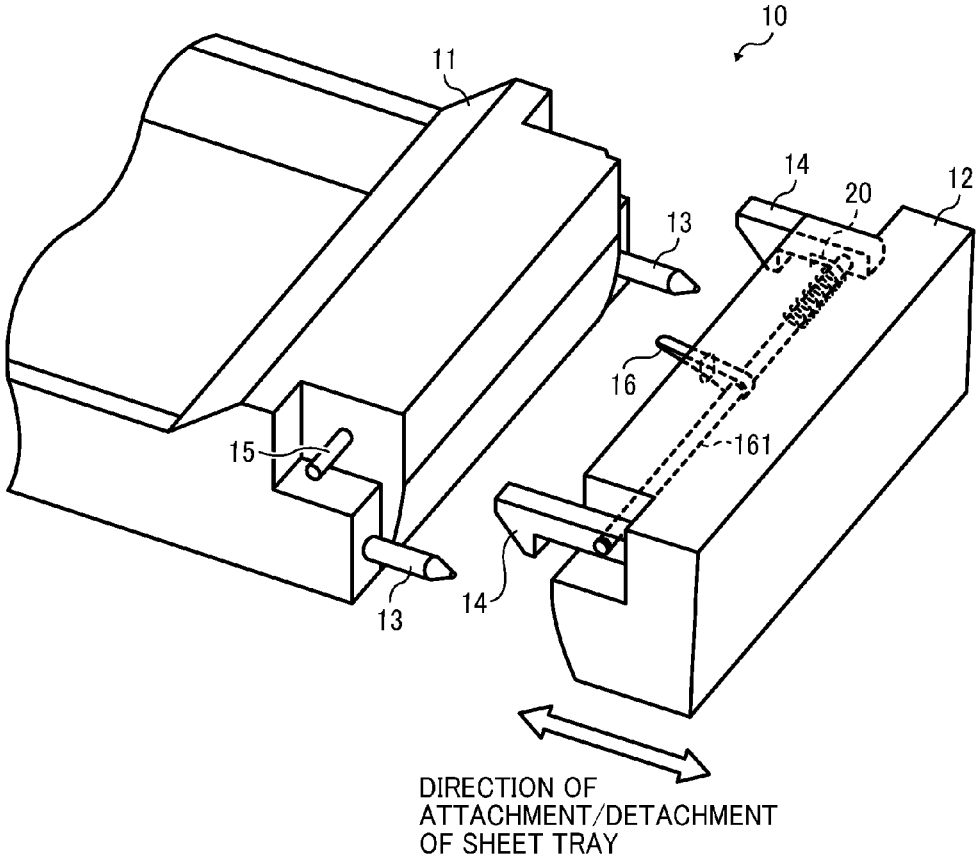
FIG. 5 is a perspective view illustrating the sheet tray.

A description is now given of a configuration and operation of the sheet trays 10 according to a first illustrative embodiment with reference to FIGS. 3 to 5. FIG. 3 is an enlarged cross-sectional view illustrating an example of a configuration of the sheet trays 10B and 10C according to the first illustrative embodiment in a state in which neither of the sheet trays 10B and 10C supplies the sheet P. FIG. 4 is an enlarged cross-sectional view illustrating an example of a configuration of the sheet trays 10B and 10C according to the first illustrative embodiment in a state in which the sheet P is supplied from the sheet tray 10C. In FIG. 4, the sheet P fed from the sheet tray 10C is jammed in a conveyance path part in the sheet tray 10B.

It is to be noted that the sheet trays 10A, 10B, 10C, and 10D according to the first illustrative embodiment have the same configuration, and suffixes A, B, C, and D of reference numerals respectively denoting components provided to the sheet trays 10 are hereinafter omitted.

FIG. 5 is a perspective view illustrating a configuration of the sheet tray 10.

The sheet tray 10 includes a tray portion 11 that holds a stack of sheets P and a separate cover member 12 provided downstream from the tray portion 11 in a sheet feeding direction in which the sheet P is fed from the sheet tray 10. A pair of opposed positioning pins 13 project from the tray portion 11 of the sheet tray 10 that position the tray portion 11 and the cover member 12 relative to each other, a pair of opposed engagement levers 14 are provided to the cover member 12, engagement pins 15 are provided to the tray portion 11 to engage the engagement levers 14, respectively, and a detection lever 16 is provided to the cover member 12 to operate in conjunction with the engagement levers 14.

A gap through which the sheet P can pass in a substantially vertical direction is formed between the tray portion 11 and the cover member 12.

The engagement levers 14 and the engagement pins 15 together form a lock assembly.

The sheet feeder 8 is constructed of the sheet trays 10 and the roller assembly provided to the image forming apparatus 1 shown in FIG. 3. The roller assembly includes a feed roller 17 and a paired conveyance roller 18, both of which are provided for each of the sheet trays 10. The feed roller 17 feeds the sheet P from the tray portion 11 of the sheet tray 10, and the conveyance roller 18 conveys the sheet P fed from the tray portion 11 in the substantially vertical direction.

The tray portion 11 of the sheet tray 10 includes a separation mechanism 19 (shown in FIG. 3) disposed immediately downstream from the feed roller 17 to separate a sheet P placed at the top of the stack of sheets P (hereinafter referred to as a top sheet P) from the rest of the stack of sheets P so that only the top sheet P is fed from the tray portion 11.

The detection lever 16 has a free end disposed within the gap between the tray portion 11 and the cover member 12 through which the sheet P can pass, and a fixed end (support end) provided to a rotary shaft 161 disposed within the cover member 12. The free end of the detection lever 16 is always returned to its home position by a return member 20. In the present embodiment, the return member 20 is a coil spring or an extension spring.

When the detection lever 16 is positioned at the home position, the engagement levers 14 engage the engagement pins 15, respectively, so that the tray portion 11 and the cover member 12 remain engaged. Accordingly, the tray portion 11 and the cover member 12 are together withdrawable from the image forming apparatus 1 as a single integrated unit.

When the sheet P passes through the gap formed between the tray portion 11 and the cover member 12, a leading edge of the sheet P moves the detection lever 16 upward. The upward movement of the detection lever 16 is transmitted to the engagement levers 14 via a link member so that the engagement levers 14 are disengaged from the engagement pins 15, respectively.

In the present embodiment, the link member is constructed of the rotary shaft 161 and the engagement levers 14, a fixed end of each of which is disposed on the rotary shaft 161. However, the configuration of the link member is not limited thereto as long as movement of the detection lever 16 is mechanically transmitted to the engagement levers 14.

In the present embodiment, the detection lever 16, the return member 20, and the rotary shaft 161 together form a switching mechanism that switches a state of the tray portion 11 and the cover member 12 between an engaged state in which the tray portion 11 and the cover member 12 engage with each other and a disengaged state in which the cover member 12 is disengaged from the tray portion 11.

When the image forming apparatus 1 receives an instruction to form an image, the feed roller 17, the conveyance roller 18, and the separation mechanism 19 are driven to feed the top sheet P from the sheet tray 10. The sheet P passes through the gap formed between the tray portion 11 and the cover member 12 to be conveyed between the photoconductor 3 and the transfer roller 5.

At that time, the free end of the detection lever 16 disposed within the gap is lifted by the leading edge of the sheet P passing through the gap, thereby disengaging the engagement levers 14 from the engagement pins 15. As a result, in a case in which the sheet P is jammed while being conveyed, only the cover member 12 is withdrawn from the image forming apparatus 1 to expose the conveyance path to the outside the sheet tray 10, thereby facilitating removal of the jammed sheet.

Optionally, a cover sensor 30 such as a photosensor may be provided to the sheet feeder 8 to detect whether or not the cover member 12 is in its closed position and thus engaging the tray portion 11. When the cover sensor 30 detects that the cover member 12 is not in the closed position, the image forming apparatus 1 is controlled not to operate.

Alternatively, the sheet feeder 8 may include a lock solenoid 50 and a lock lever 51 so that the tray portion 11 and the cover member 12 remain engaged during conveyance of the sheet P, thereby preventing improper operation of the image forming apparatus 1. In such a case, the lock solenoid 50 and the lock lever 51 together form an engagement retaining unit that keeps the tray portion 11 and the cover member 12 together.

Figure 6A:
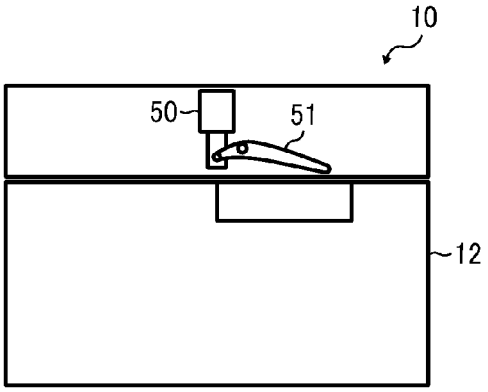
FIGS. 6A and 6B are vertical cross-sectional views respectively illustrating the sheet tray taken along a line Y1-Y1 in FIG. 2.
Figure 6B:
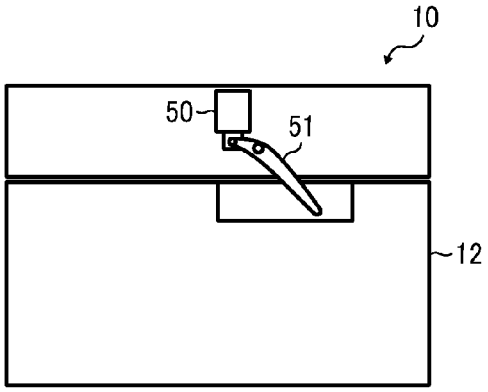

FIGS. 6A and 6B are vertical cross-sectional views respectively illustrating the sheet tray 10 taken along a line Y1-Y1 in FIG. 2, in a case in which the sheet feeder 8 is provided with the lock solenoid 50 and the lock lever 51. FIG. 6A illustrates a state in which the cover member 12 is not locked by the lock lever 51, and FIG. 6B illustrates a state in which the cover member 12 is locked by the lock lever 51.

After the image forming apparatus 1 receives an instruction to start image formation, the lock solenoid 50 is activated to insert the lock lever 51 into the cover member 12 so that the cover member 12 is locked by the lock lever 51 to keep the tray portion 11 and the cover member 12 together while the sheet P is passing through the conveyance path.

When a sensor, not shown, disposed at a nip K provided immediately upstream from the transfer roller 5 does not detect passage of a trailing edge of the sheet P after a predetermined period of time elapses after the start of sheet feeding, the lock solenoid 50 is deactivated to withdraw the lock lever 51 from the cover member 12 so that the cover member 12 is unlocked. Accordingly, the cover member 12 can be separated from the tray portion 11 to easily fix a sheet jam.

It should be noted that although in the above-described example the cover member 12 is locked when the lock solenoid 50 is activated and is unlocked when the lock solenoid 50 is deactivated, alternatively the cover member 12 may be locked when the lock solenoid 50 is deactivated and be unlocked when the lock solenoid 50 is activated.

Figure 7:
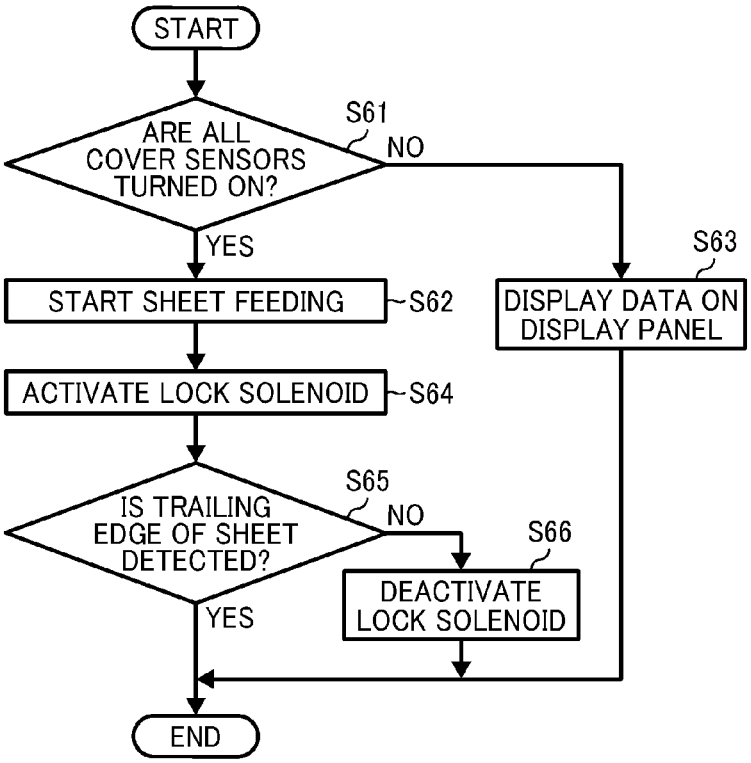
FIG. 7 is a flowchart illustrating steps in a process of sheet feeding performed by the control unit according to the first illustrative embodiment.

FIG. 7 is a flowchart illustrating steps in a process of sheet feeding performed by the control unit 9 according to the first illustrative embodiment. The steps illustrated in FIG. 7 are performed each time the image forming apparatus 1 receives the instruction to start image formation.

Upon reception of the instruction to start image formation, at S61 the CPU 91 determines whether or not all the cover sensors 30 respectively provided to the sheet trays 10 are turned on.

When determining that all the cover sensors 30 are turned on (YES at S61), at S62 the CPU 91 activates the actuators provided to the sheet feeder 8 to feed the sheet P from the predetermined sheet tray 10.

When determining that not all the cover sensors 30 are turned on, that is, any of the cover members 12 is not in the closed position (NO at S61), the process proceeds to S63 so that the display panel 96 reports that the cover member(s) 12 is not in the closed position, and the process is completed.

In other words, steps S61 and S63 together prevent sheet feeding when the cover member 12 is not in the closed position.

After the start of sheet feeding from the sheet tray 10 at S62, the lock solenoid 50 is activated at S64. Thereafter, at S65 the CPU 91 determines whether or not the trailing edge of the sheet P is detected at the nip K after a predetermined period of time elapses.

When determining that the trailing edge of the sheet P is detected (YES at S65), the CPU 91 determines that no sheet jam occurs and completes the process.

When determining that the trailing edge of the sheet P is not detected (NO at S65), the CPU 91 determines that a sheet jam has occurred and deactivates the lock solenoid 50 at S66.

In the above-described example, the detection lever 16, the engagement levers 14, the rotary shaft 161, and the return member 20 are provided to the cover member 12, and the engagement pins 15 are provided to the tray portion 11. Alternatively, the detection lever 16, the engagement levers 14, the rotary shaft 161, and the return member 20 may be provided to the tray portion 11, and the engagement pins 15 may be provided to the cover member 12.

In the first illustrative embodiment, the sheet P passing through the conveyance path provided to the front part of the sheet tray 10 is detected to mechanically disengage the cover member 12 from the tray portion 11, thereby facilitating fixing of the sheet jam with the uncomplicated configuration.

Figure 8:
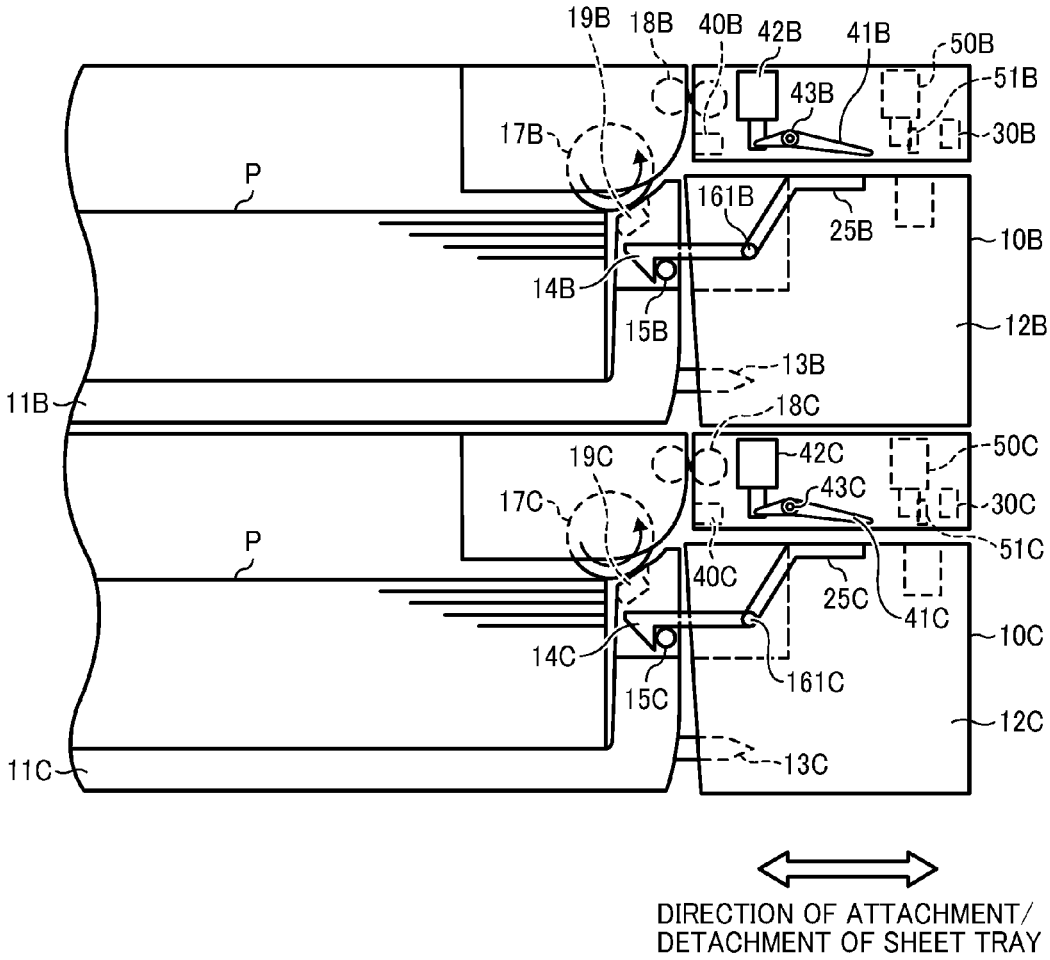
FIG. 8 is an enlarged cross-sectional view illustrating an example of a configuration of sheet trays according to a second illustrative embodiment in a state in which neither of the sheet trays supplies a sheet.
Figure 9:
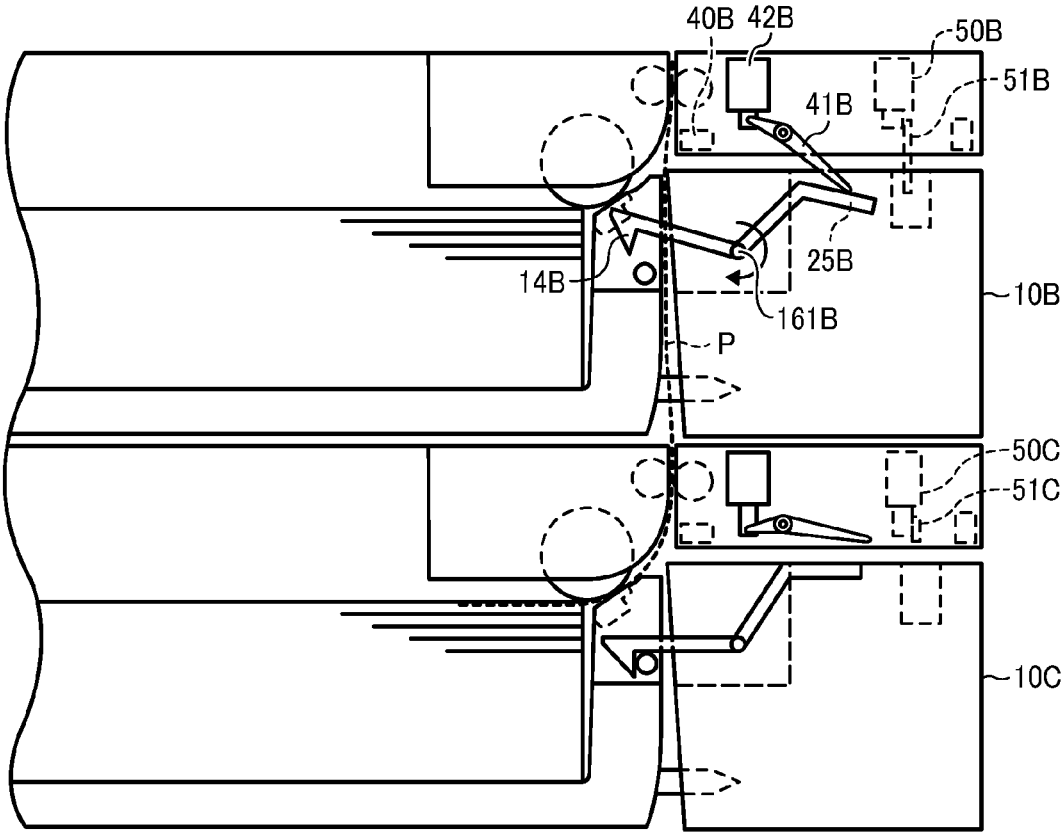
FIG. 9 is an enlarged cross-sectional view illustrating an example of a configuration of the sheet trays according to the second illustrative embodiment in a state in which a sheet is supplied.

A description is now given of a second illustrative embodiment of the present invention. FIG. 8 is an enlarged cross-sectional view illustrating an example of a configuration of the sheet trays 10B and 10C according to the second illustrative embodiment in a state in which neither of the sheet trays 10B and 10C supplies the sheet P. FIG. 9 is an enlarged cross-sectional view illustrating an example of a configuration of the sheet trays 10B and 10C in a state in which the sheet P is supplied from the sheet tray 10C. In FIG. 9, the sheet P fed from the sheet tray 10C is jammed at the conveyance path in the sheet tray 10B.

It is to be noted that the sheet trays 10A, 10B, 10C, and 10D according to the second illustrative embodiment also have the same configuration, and suffices A, B, C, and D of reference numerals respectively denoting components provided to the sheet trays 10 are hereinafter omitted. In addition, a description of those components explained above in the first illustrative embodiment is omitted, and the same reference numerals as those used in the first illustrative embodiment are used in the second illustrative embodiment.

In the second embodiment, in place of the detection lever 16 a sheet sensor 40 that detects the sheet P within the conveyance path is provided. In addition, a link lever 25 is extended from the rotary shaft 161 to a direction opposite the engagement levers 14 fixed to the rotary shaft 161. A free end of the link lever 25 contacts a first free end of a drive lever 41. The drive lever 41 is disposed in the sheet feeder 8 rotatably around a fulcrum 43. A second free end of the drive lever 41 is driven by an engagement solenoid 42 disposed in the sheet feeder 8.

In the present embodiment, the sheet sensor 40, the drive lever 41, the engagement solenoid 42, the fulcrum 43, and the link lever 25 together form the switching mechanism. The rest of the configuration of the second illustrative embodiment is the same as that of the first illustrative embodiment.

Figure 10:
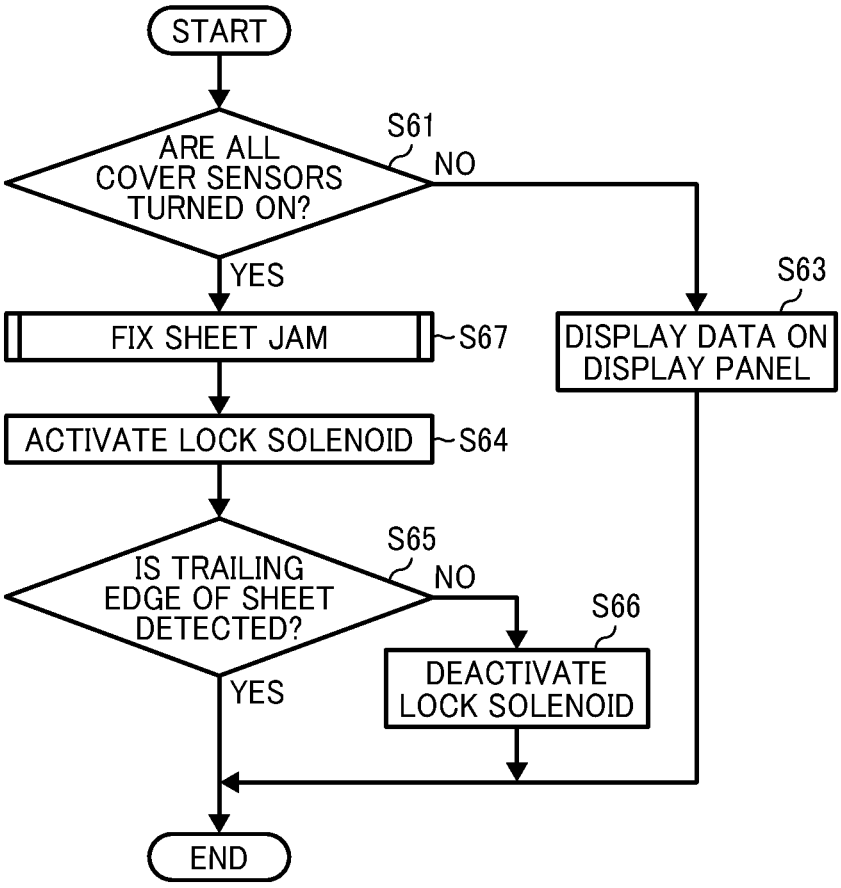
FIG. 10 is a flowchart illustrating steps in a process of sheet feeding performed by the control unit according to the second illustrative embodiment.

FIG. 10 is a flowchart illustrating steps in a process of sheet feeding performed by the control unit 9 according to the second illustrative embodiment. The steps illustrated in FIG. 10 are performed each time the image forming apparatus 1 receives an instruction to start image formation.

Differing from the process of sheet feeding according to the first illustrative embodiment, a sheet jam is fixed at S67 in the second illustrative embodiment.

Figure 11:
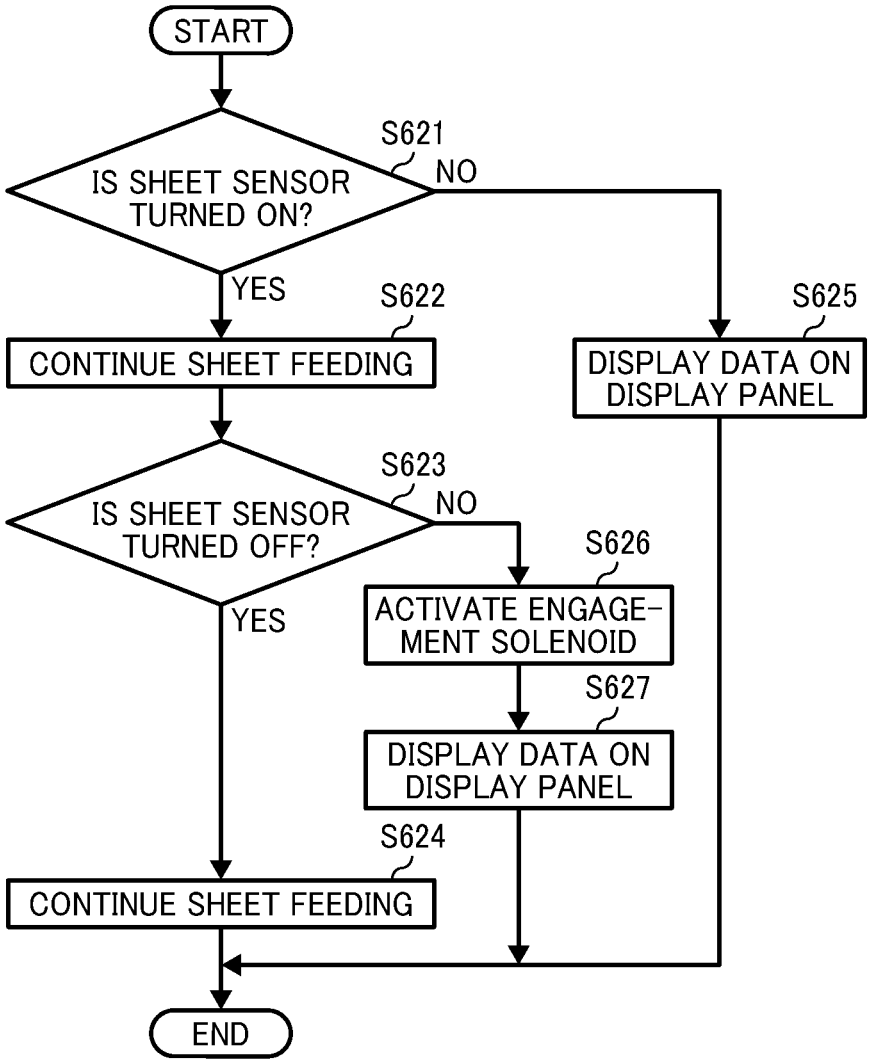
FIG. 11 is a flowchart illustrating steps in a process of fixing a sheet jam.

FIG. 11 is a flowchart illustrating steps in a process of fixing the sheet jam at S67. After the start of sheet feeding, at S621 the CPU 91 determines whether or not the sheet sensor 40 detects the sheet P and is turned on.

When determining that the sheet sensor 40 is turned on (YES at S621), at S622 the CPU 91 controls the image forming apparatus 1 to continue sheet feeding.

At S623, the CPU 91 determines whether or not the sheet sensor 40 detects absence of the sheet P and is turned off after a predetermined period of time elapses after the continuation of sheet feeding at S622.

When determining that the sheet sensor 40 is turned off (YES at S623), at S624 the CPU 91 controls the image forming apparatus 1 to further continue sheet feeding and completes the process.

Returning to S621, when determining that the sheet sensor 40 is not turned on (NO at S621), the CPU 91 determines that a sheet jam has occurred and reports a sheet jam on the display panel 96 at S625 to suspend sheet feeding.

After S622, when determining that the sheet sensor 40 is not turned off (NO at S623), the CPU 91 determines that a sheet jam has occurred and activates the engagement solenoid 42 at S626. At S627, the display panel 96 reports a sheet jam to suspend sheet feeding.

When the engagement solenoid 42 is activated, an armature is withdrawn to lift the second free end of the drive lever 41 as illustrated in FIG. 9.

Accordingly, the first free end of the drive lever 41 is lowered to push the free end of the link lever 25 downward, thereby rotating the rotary shaft 161 in a clockwise direction in FIG. 9.

As a result, the engagement levers 14 are rotated in the clockwise direction in FIG. 9 and are disengaged from the engagement pins 15, thereby disengaging the cover member 12 from the tray portion 11.

Thus, in a case in which the sheet P is jammed while being conveyed, only the cover member 12 is withdrawn from the image forming apparatus 1 to expose the conveyance path to the outside the sheet tray 10, thereby facilitating removal of the jammed sheet.

In the above-described example, the engagement solenoid 42 is activated when the sheet sensor 40 detects the sheet P. Alternatively, the engagement solenoid 42 may be deactivated when the sheet sensor 40 detects the sheet P.

In the second illustrative embodiment, the sheet P passing through the conveyance path provided to the front portion of the sheet tray 10 is detected by the sheet sensor 40 to disengage the cover member 12 from the tray portion 11 using the engagement solenoid 42, thereby facilitating fixing of the sheet jam with the uncomplicated configuration.

The foregoing illustrative embodiments are applicable to image forming apparatuses in which the direction of withdrawal of the sheet tray is parallel to the sheet feeding direction. The cover member is disengaged from the tray portion of the sheet tray so that a sheet jam can be easily fixed.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A sheet tray for feeding a sheet toward an image forming part of an image forming apparatus, the sheet tray detachably attachable to the image forming apparatus in a sheet feeding direction, comprising:

a tray portion configured to hold the sheet;

a cover member, detachable from the tray portion and disposed downstream from the tray portion in the sheet feeding direction, the cover member being provided apart from the tray portion with a gap interposed therebetween configured to pass the sheet in an engaged state in which the tray portion and the cover member are engaged with each other;

a lock assembly configured to engage the tray portion and the cover member with each other in the engaged state and configured to disengage the cover member and the tray portion from each other in a disengaged state;

a switching mechanism configured to put the lock assembly into the engaged state in absence of the sheet within the gap between the tray portion and the cover member and into the disengaged state at presence of the sheet within the gap between the tray portion and the cover member;

a detection lever having a free end disposed within the gap through which the sheet may pass and a support end disposed to one of the tray portion and the cover member;

a return member to return the detection lever to a home position; and a link member to put the lock assembly into the engaged state when the detection lever is in the home position and into the disengaged state when the detection lever is moved from the home position by the sheet passing through the gap.

2. The sheet tray according to claim 1, further comprising an engagement retaining unit to keep the tray portion and the cover member together during sheet feeding.

3. A sheet tray for feeding a sheet toward an image forming part of an image forming apparatus, the sheet tray detachably attachable to the image forming apparatus in a sheet feeding direction, comprising:

a tray portion configured to hold the sheet;

a cover member, detachable from the tray portion and disposed downstream from the tray portion in the sheet feeding direction, the cover member being provided apart from the tray portion with a gap interposed therebetween configured to pass the sheet in an engaged state in which the tray portion and the cover member are engaged with each other;

a lock assembly configured to engage the tray portion and the cover member with each other in the engaged state and configured to disengage the cover member and the tray portion from each other in a disengaged state;

a switching mechanism configured to put the lock assembly into the engaged state in absence of the sheet within the gap between the tray portion and the cover member and into the disengaged state at presence of the sheet within the gap between the tray portion and the cover member;

a sheet sensor to detect the sheet passing through the gap;

a solenoid configured to be put into one of an activated and a deactivated state upon detection of the sheet by the sheet sensor; and a link member to put the lock assembly into the engaged state when the sheet is not detected by the sheet sensor and into the disengaged state depending on the state of the solenoid when the sheet is detected by the sheet sensor.

4. The sheet tray according to claim 3, further comprising an engagement retaining unit to keep the tray portion and the cover member together during sheet feeding.

5. A sheet tray for feeding a sheet toward an image forming part of an image forming apparatus, the sheet tray detachably attachable to the image forming apparatus in a sheet feeding direction, comprising:

a tray portion configured to hold the sheet;

a cover member, detachable from the tray portion and disposed downstream from the tray portion in the sheet feeding direction, the cover member being provided apart from the tray portion with a gap interposed therebetween configured to pass the sheet in an engaged state in which the tray portion and the cover member are engaged with each other;

a lock assembly configured to engage the tray portion and the cover member with each other in the engaged state and configured to disengage the cover member and the tray portion from each other in a disengaged state; and a switching mechanism configured to put the lock assembly into the engaged state in absence of the sheet within the gap between the tray portion and the cover member and into the disengaged state at presence of the sheet within the gap between the tray portion and the cover member, wherein the cover member further comprises a cover sensor to detect that the cover member is in a predetermined position downstream from the tray portion in the sheet feeding direction.

6. The sheet tray according to claim 5, further comprising an engagement retaining unit to keep the tray portion and the cover member together during sheet feeding.

7. An image forming apparatus comprising a sheet tray for feeding a sheet toward an image forming part of the image forming apparatus, the sheet tray being detachably attachable to the image forming apparatus in a sheet feeding direction and comprising:

a tray portion configured to hold the sheet;

a cover member detachable from the tray portion and disposed downstream from the tray portion in the sheet feeding direction, the cover member being provided apart from the tray portion with a gap interposed therebetween configured to pass the sheet in an engaged state in which the tray portion and the cover member are engaged with each other;

a lock assembly configured to engage the tray portion and the cover member with each other in the engaged state and configured to disengage the cover member and the tray portion from each other in a disengaged state;

a switching mechanism configured to put the lock assembly into the engaged state in absence of the sheet within the gap between the tray portion and the cover member and into the disengaged state at presence of the sheet within the gap between the tray portion and the cover member;

a detection lever having a free end disposed within the gap through which the sheet may pass and a support end disposed to one of the tray portion and the cover member;

a return member to return the detection lever to a home position; and a link member to put the lock assembly into the engaged state when the detection lever is in the home position and into the disengaged state when the detection lever is moved from the home position by the sheet passing through the gap.

8. An image forming apparatus comprising a sheet tray for feeding a sheet toward an image forming part of the image forming apparatus, the sheet tray being detachably attachable to the image forming apparatus in a sheet feeding direction and comprising:

a tray portion configured to hold the sheet;

a cover member detachable from the tray portion and disposed downstream from the tray portion in the sheet feeding direction, the cover member being provided apart from the tray portion with a gap interposed therebetween configured to pass the sheet in an engaged state in which the tray portion and the cover member are engaged with each other;

a lock assembly configured to engage the tray portion and the cover member with each other in the engaged state and configured to disengage the cover member and the tray portion from each other in a disengaged state;

a switching mechanism configured to put the lock assembly into the engaged state in absence of the sheet within the gap between the tray portion and the cover member and into the disengaged state at presence of the sheet within the gap between the tray portion and the cover member;

a sheet sensor to detect the sheet passing through the gap;

a solenoid configured to be put into one of an activated and a deactivated state upon detection of the sheet by the sheet sensor; and a link member to put the lock assembly into the engaged state when the sheet is not detected by the sheet sensor and into the disengaged state depending on the state of the solenoid when the sheet is detected by the sheet sensor.

9. An image forming apparatus comprising a sheet tray for feeding a sheet toward an image forming part of the image forming apparatus, the sheet tray being detachably attachable to the image forming apparatus in a sheet feeding direction and comprising:

a tray portion configured to hold the sheet;

a cover member detachable from the tray portion and disposed downstream from the tray portion in the sheet feeding direction, the cover member being provided apart from the tray portion with a gap interposed therebetween configured to pass the sheet in an engaged state in which the tray portion and the cover member are engaged with each other;

a lock assembly configured to engage the tray portion and the cover member with each other in the engaged state and configured to disengage the cover member and the tray portion from each other in a disengaged state; and a switching mechanism configured to put the lock assembly into the engaged state in absence of the sheet within the gap between the tray portion and the cover member and into the disengaged state at presence of the sheet within the gap between the tray portion and the cover member, wherein the cover member further comprises a cover sensor to detect that the cover member is in a predetermined position downstream from the tray portion in the sheet feeding direction.

* * * * *